United States Patent [19]

Frolov

[11] Patent Number: 4,783,882

[45] Date of Patent: Nov. 15, 1988

[54] DOOR CLOSER ASSEMBLY

[75] Inventor: George Frolov, Farmington, Conn.

[73] Assignee: Emhart Industries, Inc., Farmington, Conn.

[21] Appl. No.: 818,155

[22] Filed: Jan. 13, 1986

[51] Int. Cl.[4] ..... E05F 1/08

[52] U.S. Cl. ..... 16/72; 16/49; 16/DIG. 10; 267/177

[58] Field of Search ..... 16/49, 52, 53, 58, 72, 16/DIG. 9, DIG. 10, DIG. 36; 267/175, 177

[56] References Cited

U.S. PATENT DOCUMENTS

| | | | |
|---|---|---|---|
| 367,020 | 7/1887 | Barlow | 16/72 |
| 454,078 | 6/1891 | Smith | 16/49 |
| 762,767 | 6/1904 | Scott . | |
| 1,632,924 | 6/1927 | Schmidt | 16/72 |
| 1,687,009 | 10/1928 | Drexler | 16/49 |
| 1,723,445 | 5/1927 | Schmitt . | |
| 2,923,026 | 2/1960 | Nack | 16/49 |
| 3,207,270 | 8/1964 | Ellis . | |
| 3,491,993 | 1/1970 | Scholin . | |
| 3,911,527 | 10/1975 | Lasier | 16/64 |
| 3,990,548 | 11/1976 | Schupner | 16/52 |
| 4,590,639 | 5/1986 | Fritsche | 16/79 |

FOREIGN PATENT DOCUMENTS

| | | | |
|---|---|---|---|
| 916897 | 1/1963 | United Kingdom | 267/177 |

*Primary Examiner*—Kurt Rowan

*Attorney, Agent, or Firm*—Barry E. Deutsch

[57] ABSTRACT

A door closer assembly for connection between door and frame members relatively movable between open and closed positions includes a housing having a power screw rotatably mounted therewithin. A follower is mounted on the screw and moves axially along the screw when the screw is rotated. A spring is disposed in the chamber and is compressed by the follower. A handle member is mounted for rotation about a first end of the housing and is connected to the screw for rotation therewith. An indicating member is mounted on the housing for axial movement relative thereto. The indicating member is in engagement with the handle whereby rotation of the handle results in simultaneous axial movement of the follower and the indicator member. The indicator member includes visually observable means for indicating the relative degree of compression of the spring.

3 Claims, 1 Drawing Sheet

DOOR CLOSER ASSEMBLY

BACKGROUND OF THE INVENTION

This invention relates in general to door closing assemblies, and in particular, to an assembly having a device for indicating the relative degree of compression of the closer spring.

A typical door closer assembly to which the present invention relates is connected between a door and its frame to exert a closing force on the door when it is released in an open position. Such a door closer assembly usually includes a relatively strong closer spring, which provides a reactive force for closing the door, and a dampening mechanism which resists the force of the closer spring and controls the speed at which the door closes. The closer assembly generates a closing force to close the door against normally anticipated wind force if the door is used to control access to a building from the outside, or force generated by pressure differentials within a building if the door is located within a structure.

The closer spring is prestressed so that the closer assembly exerts some force on the door in a closing direction even when the door is closed. This closing force must be overcome when the door is opened. Suitable means are provided so that the degree of compression of the spring may be varied to vary the reactive force generated by the spring. Since the spring is typically sealed within a chamber of the door closer housing, proper adjustment of the spring to obtain a desired reactive force has typically been a "trial and error" process. Trial and error processes are generally time consuming. Accordingly, it is an object of the present invention to provide a door closer assembly having a visually observable indicator means for indicating the relative degree of compression of the closer spring.

SUMMARY OF THE INVENTION

A door closer assembly for connection between door and frame members relatively movable between open and closed positions comprising a housing member defining a longitudinally extending chamber; force generating means disposed in said chamber for providing a door closing force; follower means connected to said force generating means for varying the force generated therefrom upon movement of said follower means relative thereto; handle means connected to said follower means and mounted for rotation about a first end of the housing member, with rotation of said handle means resulting in simultaneous movement of said follower means; and indicia means mounted on the housing member for axial movement relative thereto and being in engagement with said handle means whereby rotation of the handle means results in simultaneous movement of said follower and said indicia means, said indicia means including first visually observable means for indicating the relative change in the force generated by said force generating means.

BRIEF DESCRIPTION OF THE DRAWING

FIG. I is an elevational view of a door closer assembly of the type to which the present invention pertains.

DESCRIPTION OF THE PREFERRED EMBODIMENT

Figure 1:
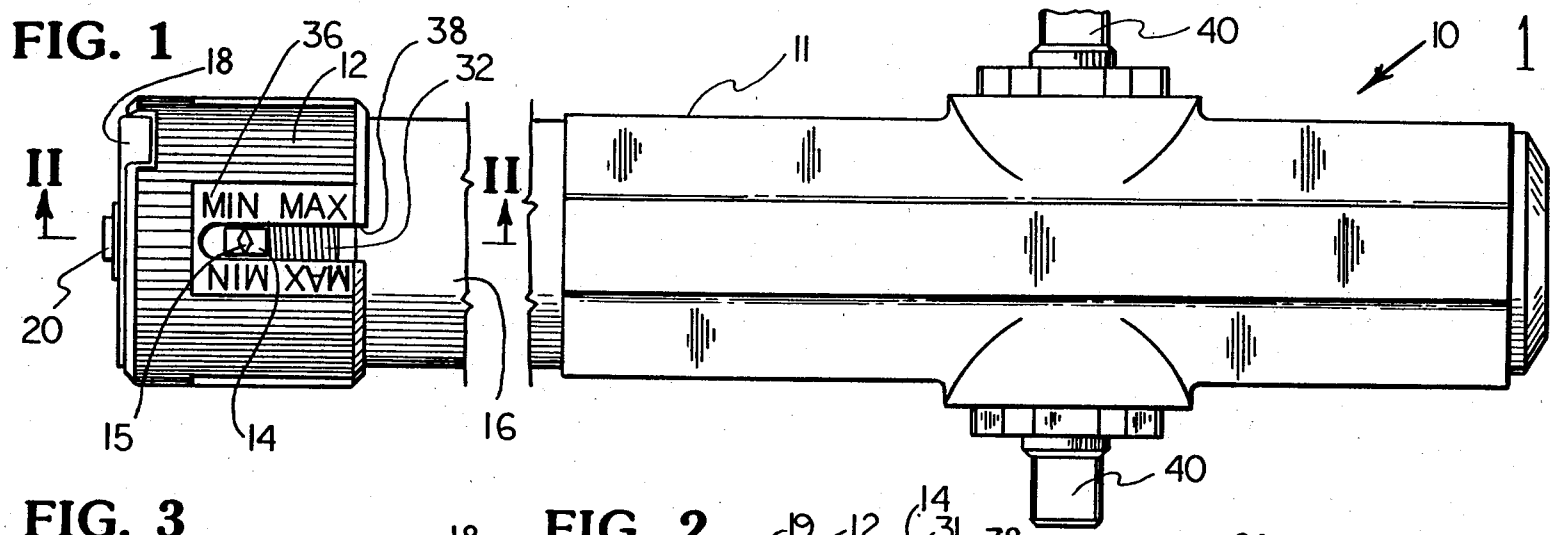

Referring now to the drawing, there is disclosed a preferred embodiment of the present invention. In referring to the various figures of the drawing, like numerals shall refer to like parts.

FIG. 1 illustrates an elevational view of a door closer assembly 10 of the type to which the present invention pertains. In particular, assembly 10 includes a first housing 11 and a second housing 16 of slightly smaller diameter, and extending from one end of housing 11. The end of housing 16 remote from housing 11 has threads 32 formed on its exterior surface. The main operating components of the door closer assembly are disposed in a chamber found in housing 11. Since these components form no part of the present invention and are standard and well-known to those skilled in the art, the details of such components have not been shown for the sake of brevity. Suffice to say, such components may include a piston member mounted for reciprocal movement in the chamber and having a rack formed thereon to engage a pinion formed with spindle 40. Thus, movement of the piston causes the spindle to rotate. The spindle in turn, is connected to one of the arms of the door closer assembly. Door closers of this type are sold under the Registered Trademark "CORBIN" by the Hardware Division of Emhart Corporation and include the "CORBIN" Series 120 Door Closers.

Figure 2:
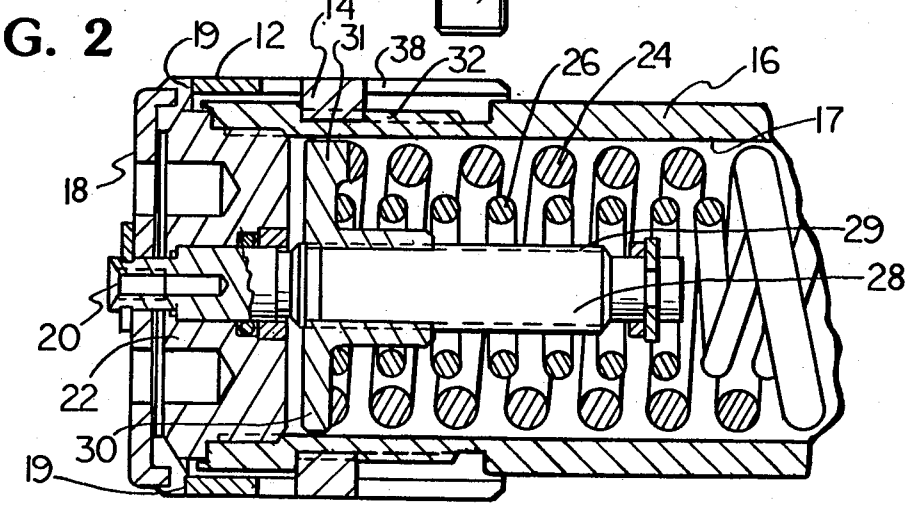
FIG. 2 is a sectional view taken along II-II of FIG 1.

As illustrated in FIG. 2, housing 16 defines chamber 17. Springs 24 and 26 are mounted within chamber 17 about a power screw 28. Springs 24 and 26 provide a reactive force for closing the door on which assembly 10 is mounted. An axially movable follower member or power nut 30 is provided on screw 28. Member 30 includes finger 31 which engages a complementary surface on spring 24 to prevent the follower from rotating together with screw 28. The relative change of position of follower 30 in an axial direction within chamber 17 varies the reactive force generated by springs 24 and 26. Rotation of screw 28 in a first direction causes follower 30 to move axially towards the right as viewed in FIG. 2 to increase the reactive force generated by the springs. Likewise, rotation of the screw in the opposite direction results in follower 30 moving axially toward the left as viewed in the figure to decrease the reactive force generated by the springs. A generally cylindrical plug 22 is used to close-off the end of the cylinder.

Figure 3:
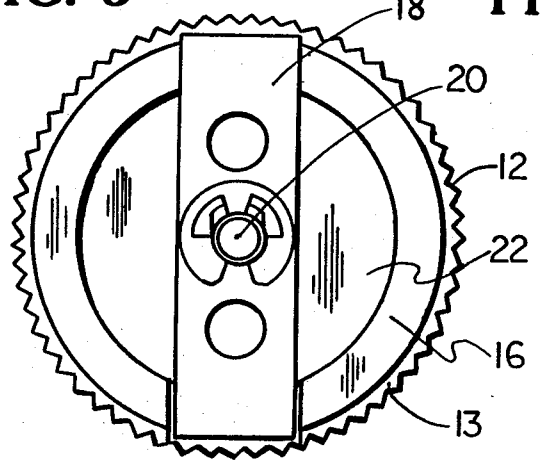
FIG. 3 is an end view of the door closer assembly.

A rotatable cover member or handle 12 is mounted about the threaded end of housing 16. A shown in FIGS. 1 and 3, the outer surface of handle 12 preferably includes knurls 13 for ease of manipulation. Handle 12 includes at least one axially extending slot 38. In the preferred embodiment, the handle includes four axially extending slots spaced apart approximately 90 degrees about the circumference of the handle. Indicia means 36 is provided on the exterior surface of handle 12 adjacent slot 38.

A nut-like member 14 is threadably received on the threaded portion 32 of housing 16. As illustrated in FIG. 2, it will be noted that upraised portions on nut 14 extend within slot 38 so that rotation of handle 12 results in rotation of the nut. A pointer or similar indicium means 15 is located on the peripheral surface of nut 14 for a reason to be more fully explained hereinafter.

A generally U-shaped bracket 18 is connected at its center via rivet 20 or similar means to power screw 28. In addition, bracket 18 is connected to rotatable handle 12 as the legs of the bracket extend within slots 19 formed in the handle. Thus, bracket 18 functions as a link connecting cover 12 and screw 28. It should be understood that handle 12 and bracket 18 can be formed as a unitary member. In the present embodiment, handle 12 is formed from a plastic material and does not have the structural strength to transmit force directly to rotate screw 28. Hence bracket 18, made from steel or similarly strong material, is used to transmit the force from handle 12 to screw 28.

As indicated previously, the reactive force generated by springs 24 and 26 may be varied by moving follower 30 axially along the screw. Heretofore, adjustment of the spring force has generally been through trial and error procedures as prior art door closer assemblies have not included readily usable means for determining the relative degree of adjustment of the follower or of the spring force generated by the springs.

The present invention overcomes the prior art infirmity by providing suitable means to give an operator visually observable means indicating the relative degree of compression of springs 24 and 26.

Thus, to vary the force generated by the springs, an operator would rotate handle 12 in a desired direction, for example in a clockwise direction to increase the force generated by the spring. In turning the handle in the clockwise direction, nut 14 would likewise be rotated in a clockwise direction. Similarly, due to the connecting linkage provided by bracket 18, rotation of the cover results in rotation of screw 28 thereby moving follower 30 in an axial direction. Since nut 14 is threadably mounted on the exterior surface of housing 16, rotation of the nut results in axial movement thereof relative to the handle. Thus, as the nut moves axially along the threaded portion 32 of housing 16, indicium means 15 appearing on the peripheral surface of the nut moves relative to indicia 36 appearing on the surface of the handle adjacent slot 38. The change in the position of the indicia relative to each other provides the operator with visually observable means which represents the relative degree of compression of springs 24 and 26. It should be recognized that the specific indicia used on the handle and adjustable nut may be replaced by other suitable indicia.

The present invention can be modified by changing the shape of handle 12 from the cylindrical form shown to one that is generally U-shaped. The legs of the U would extend parallel to the longitudinal axis of housing 16. Likewise to accommodate the change in handle 12, nut 14 would require design modification; namely the nut would include two slots to accept the legs of the U-shaped handle. Suitable indicia would be placed on the legs of the handle and on the surface of the nut. Rotation of the U-shaped handle would result in axial movement of the nut along threads 32 of housing 16.

While a preferred embodiment of the invention has been described and illustrated, the invention should not be limited thereto but may be otherwise embodied within the scope of the following claims.

I claim:

1. A door closer assembly for connection between door and frame members relatively movable between open and closed positions, said assembly comprising:

a housing member defining a longitudinally extending chamber and including screw threads formed on the external wall thereof adjacent a first end;

a screw-like member rotatably mounted within the chamber;

a follower mounted on the screw-like member and movable axially therealong upon rotation thereof;

spring means disposed in said chamber and engaged by said follower with axial movement of said follower relative to said screw-like member varying the degree of compression of said spring means;

handle means connected to said screw-like member and mounted for rotation about the first end of said housing member and including at least one axially elongated slot extending parallel to the longitudinal axis of said housing member with rotation of said handle means resulting in rotation of said screw-like member; and an indicator nut having screw threads engageable with the housing screw threads and including at least one upstanding lug member positioned within the slot of said handle means whereby rotation of said handle means results in simultaneously axial movement of said follower and said indicator nut.

2. A door closer assembly in accordance with claim 1 wherein the lug includes first visually observable indicium in the peripheral wall thereof and said handle means includes second visually observable indicia positioned adjacent said slot, with relative movement between said indicia indicating the relative degree of compression of said spring.

3. A door closer assembly in accordance with claim 1 including linkage means connecting said handle means to said screw-like member.

* * * * *